US007150122B1

(12) United States Patent
Ha

(10) Patent No.: US 7,150,122 B1
(45) Date of Patent: Dec. 19, 2006

(54) AUTO-EJECT GUN-LOCK DEVICE WITH RING-MOUNTED KEY

(76) Inventor: Don Dongcho Ha, 404 E. First St., #607, Long Beach, CA (US) 90802

( * ) Notice: Subject to any disclaimer, the term of this patent is extended or adjusted under 35 U.S.C. 154(b) by 376 days.

(21) Appl. No.: 10/820,987

(22) Filed: Apr. 8, 2004

(51) Int. Cl.
*F41A 17/00* (2006.01)

(52) U.S. Cl. ..... 42/70.11; 42/66

(58) Field of Classification Search ..... 42/44, 42/70.11, 70.04, 70.08, 70.01, 66; 89/27.12
See application file for complete search history.

(56) References Cited

U.S. PATENT DOCUMENTS

| | | | | |
|---|---|---|---|---|
| 4,398,366 | A * | 8/1983 | Wernicki | 42/70.11 |
| 4,512,099 | A * | 4/1985 | Mathew | 42/70.11 |
| 5,115,589 | A * | 5/1992 | Shuker | 42/70.11 |
| 5,239,767 | A * | 8/1993 | Briley et al. | 42/70.11 |
| 5,289,653 | A * | 3/1994 | Szebeni et al. | 42/70.11 |
| 5,475,994 | A * | 12/1995 | Briley et al. | 70/34 |
| 5,491,918 | A * | 2/1996 | Elmstedt | 42/70.11 |
| 5,664,358 | A * | 9/1997 | Haber et al. | 42/70.11 |
| 5,699,687 | A * | 12/1997 | Pittman | 70/376 |
| 5,860,241 | A * | 1/1999 | Waters | 42/70.11 |
| 6,560,910 | B1 * | 5/2003 | McLaren | 42/70.11 |
| 6,584,718 | B1 * | 7/2003 | Serrao | 42/70.11 |
| 2005/0086846 | A1 * | 4/2005 | Beretta | 42/70.11 |

* cited by examiner

*Primary Examiner*—Michael J. Carone
*Assistant Examiner*—Benjamin P. Lee

(57) ABSTRACT

A gun-lock device includes a tubular assembly that fits within the bore and a chamber plug member that fits within the chamber of a firearm. The tubular assembly is partially received into the chamber plug member, wherein spring-loaded expandable arrangement at the end thereof engages with the recess within the chamber plug member to lock the tubular assembly within the barrel. The lock subassembly includes a tumbler cylinder arranged to rotate about the longitudinal axis of the tubular assembly and a set of lock-pins which are disposed parallel to, and in a circular formation about, the longitudinal axis of the tumbler cylinder. The resulting overall arrangement yields a compactly packaged gun-lock device suitable for use in combination with a holster-worn firearm, and the key, with such small size and ornate shape, suitable for being mounted on a ring to be worn by the user at all times. A spring loaded plunger mechanism enhances the speed and ease of operation by adding a self-eject feature to the device.

26 Claims, 7 Drawing Sheets

AUTO-EJECT GUN-LOCK DEVICE WITH RING-MOUNTED KEY

REFERENCES CITED (REFERENCED WITHIN THE SPECIFICATION)

| | | |
|---|---|---|
| 4398366 | August 1983 | Wernicki |
| 4512099 | April 1985 | Mathew |
| 5289653 | March 1994 | Szebeni et al. |
| 5475994 | December 1995 | Briley, Jr. et al. |
| 5491918 | February 1996 | Elmstedt |
| 5664358 | September 1997 | Haber et al. |
| 5860241 | January 1999 | Waters |
| 6560910 | May 2003 | McLaren |

CROSS-REFERENCE TO RELATED APPLICATIONS

Not applicable.

BACKGROUND OF THE INVENTION

1. Technical Field

This invention relates to a safety gun-lock device for firearms, and more particularly for handguns for preventing unauthorized use, yet allow speedy unlocking and removal of the gun-lock device for authorized use of the firearm.

2. Description of the Related Art

Several of existing gun-lock devices are made in the form of a "barrel lock", wherein a tubular body portion of the gun-lock device is inserted into the barrel and the firing chamber portions of the firearm and is locked in position to render the firearm inoperative until such device is removed. This type of device generally incorporates a chamber-engaging arrangement at one end of a tubular body to cooperate with a lock arrangement at the opposite end of the tubular body to prevent unauthorized withdrawal. Further, in some, the chamber-engaging arrangement employs a chamber plug, or a "dummy-cartridge", which is inserted into the firing chamber from the breach end of the barrel to cooperate with the tubular body portion to strengthen the chamber engagement. Once installed and locked, the tubular body and the chamber plug member block the barrel and the firing chamber of the firearm to render it completely inoperative until removed. The lock mechanism arrangement used by the prior art consists of a combination, key, or an electronic type commonly known in the art.

The problem with the prior art is that unlocking the gun-lock device depends on the user to remember the correct preset combination or the location where the key was last placed, and it also requires a sufficient level of manual dexterity for the user to successfully negotiate the lock mechanism and to remove it from the firearm.

To illustrate the unlocking operation of a prior art device utilizing a combination lock arrangement such as that of McLaren, the gun owner would be required to, first, successfully retrieve the correct preset combination from his memory, second, manually adjust the lock arrangement to the correct combination, third, twist the knob to unlock the chamber-engaging arrangement, then finally, manually withdraw the gun-lock device from the barrel of the gun.

Operation of the prior art of Briley, Jr. et al. is similar, except that after adjusting the combination lock, it further requires manually depressing the interposer lever, then, manually pushing on the plunger member to disengage with the chamber plug, then finally, while maintaining the plunger pushed, withdrawing the gun-lock device out from the gun barrel. Unlocking the electronic combination type lock, such as that of Waters, involves similar operations as above, however, in addition, the user must always maintain the battery in good operating condition.

To illustrate the unlocking operation of a prior art device utilizing a key lock arrangement of a common use type such as that of Elmstedt or Szebeni et al., the gun owner would be required to, first, successfully remember where he last placed the key and physically retrieve it, second, correctly insert it into the lock cylinder and unlock the lock arrangement, then finally, manually withdraw the gun-lock device out from the gun barrel.

It is well known, that a person may suffer temporary symptoms of memory loss and/or diminished level of manual coordination during an encounter with a life-threatening situation. The panic state may rob one of his normal ability to effectively operate and remove the lock device in time of need, and thus, any complexity involving the required procedure to remove the gun-lock device, such as those of the prior art as illustrated above, is not only inconvenient, but is potentially endangering to one's life.

The lock subassemblies incorporated in the referenced prior art examples are all physically too bulky for satisfaction by the gun-owner. It is often desired that the handgun worn by a law enforcement officer on duty to be minimally protected by a lock device of sort, such that during an arrest, it would prevent the suspect from intercepting the gun and use it against the arresting officer. Because of the bulk and of the complexity required to unlock as described above, none of these referenced prior art examples are considered suitable for being used with a holster-worn handgun.

BRIEF SUMMARY OF THE INVENTION

This invention addresses the concerns outlined above and presents a better gun-lock device of a barrel lock type utilizing a chamber plug member which may be quickly unlocked without requiring a high level of manual dexterity nor relying on the gun-owner's memory. The gun-lock device may be operated without sight, and in total darkness using tactile senses only. The lock mechanism and the key of the invention are so shaped and sized that it is possible to have the key mounted on a ring, so that it may be worn on a finger and thus is available for use by the gun owner at all times. To unlock and remove the device of the present invention would not require the gun owner to remember where the key was last placed nor the correct preset combination. The gun-owner would simply bring his hand on which the key is worn toward the receiving face of the lock mechanism, and through use only of his tactile senses, insert the key into the lock mechanism, whereon the key will be guided by its own guiding feature into correct engagement with the lock mechanism. With a slight turning of the key, the device would unlock and immediately auto-eject out from the gun barrel. A revolver type handgun will, then, be ready to fire. A semi-automatic type handgun will become ready to fire immediately following cycling of its action, which will remove the chamber plug member out of the chamber by way of the handgun's own ejector mechanism and insert a live round of ammunition into the chamber.

Some user may prefer to wear the ring such that the key is on the palm side of the hand. If worn this way, all of the user's fingers will be better positioned to cradle the exterior of the gun barrel as the key is being inserted, so even greater degree of tactile sense feedback may be afforded to further improve the speed at which the key is engaged with the lock mechanism. The key may be worn on any finger, in any orientation, and on either of user's hands depending on the individual's preference and on his instinctive movements of the hands and arms, so as long as it allows speedy and effective key-to-lock engagement at all times.

The illustrated embodiment achieves those and much more. The chamber plug member, also referred herein as "dummy cartridge", forms a part of the invention to provide a clearly-defined and rigid shoulder surface for which the expanding barb members of the mating tubular assembly to engage with to create a reliable and sturdy chamber-engaging arrangement. This arrangement is clearly an improvement over those of prior art of McLaren and of Waters, which rely on balls to oppose directly against the narrow edge existing between the bore and the firing chamber of the handgun, and over those of prior art of Szebeni, of Mathew, and of Haber, which rely on expanding collets or wedges to oppose directly against the same narrow edge. Because of the small difference between the bore and the chamber diameters of most modern gun designs, the width of this edge is very narrow and thus cannot sufficiently provide as a barrier means to prevent the gun-lock device from being pulled out from the chamber through the bore of the firearm. With force exerted during an unauthorized removal attempt, the parts of the gun-lock device engaging with the narrow edge, the narrow edge itself, and/or the body of the lock-device may breakdown and cause the chamber-engaging arrangement to fail. A forced tamper attempt would likely to inflict damage to both the handgun and the prior art gun-lock device, and ultimately may result in an inadvertent removal of the device from the handgun.

At the distal end of the tubular assembly of the present invention where it forms a chamber-engaging arrangement with the chamber plug member are pivotally mounted movable barb members, which are maintained spring energized in their normally expanded positions. There are two barb members arranged in symmetry to provide an even strength. During insertion, the barb members retract into the body of the tubular assembly upon contacting the mouth of the chamber plug member and allow themselves to be inserted into the cavity within the chamber plug member. After the insertion, the barb members automatically expand back to their normal, engaged positions. Therefore, the present invention may be placed into the locked configuration simply by inserting the tubular assembly into the bore and pushing it inward of the chamber plug member placed in the chamber of the firearm.

This is a further improvement over those chamber-engaging arrangements of the prior art, which require additional manual inputs from the gun-owner to complete the locking operation. For example, the prior art of McLaren requires a twist of the knob to, first, cause the balls to engage with the chamber wall, followed by, second, a manual operation of the locking bar into the engaged position, and then finally adjusting the combination rings out of the correct preset combination. Similarly, the prior art of Briley, Jr. et al requires first, verify initially that the lock mechanism is at the correct unlock combination, second, manually actuate the interposer member, third, press and hold the plunger mechanism, fourth, insert the tube into the bore and release the plunger mechanism to engage with the dummy cartridge placed in the chamber, then finally, adjust the knob out of the correct preset combination. The prior art examples of both Elmstedt and Mathew require, first, placing the key into the lock arrangement, then, ensuring the gun-lock device is fully inserted into its respective position, manually operate the key toward the locked configuration.

The tumbler cylinder of the present invention fits within the head of the lock subassembly and is allowed to be rotated a partial turn when the correct key is inserted. The limits of the turn are precisely governed by the mechanical stops at both ends. The tumbler cylinder is spring loaded to return to and maintained at its normally locked position. On the frontal contacting surfaces of the tumbler cylinder and the key are an asymmetrical recess feature and a matching projection feature, respectively, which are designed to help guide the key into correct insertion into the lock arrangement. The asymmetrical shape of these matching features ensure that the key is inserted only when it is properly aligned in correct angular relationship with respect to the tumbler cylinder. Further, the lock arrangement of the present invention operates on a concept similar to that of existing variety of lock-pin tumbler design commonly used in many padlocks and door-lock devices, except that the lock-pins of the present invention are disposed parallel to and in a circular formation about the axis of rotation of the tumbler cylinder, whereas in an existing variety, the lock-pins are disposed in a row, perpendicular to the axis of rotation of the tumbler cylinder. The parallel-axes arrangement affords the present invention an advantage, as such arrangement reserves a compact physical packaging possibility. For example, for a gun-lock device for large-bore handguns of such calibers as .40 S&W and .45 ACP, the lock pins may be arranged in a circular formation of such diameter which may be housed within the portion of the tubular assembly that fit within the bore of the gun barrel. It will then leave only a small portion of the gun-lock device to remain extending outside of the gun barrel. For smaller caliber handguns, of calibers such as the 38 special, .357 Magnum, .380 ACP, and 9 mm, the lock pins may be packaged within that exposed portion of the tubular assembly which remain extending outside of the barrel. However, because the parallel-axes lock-pin arrangement requires a housing of much smaller diameter than those of conventional arrangements based on the lock-pin tumbler or the combination disks designs, the overall physical size of that portion of the present invention which remain exposed outside of the gun barrel may be significantly less than those of the prior art examples. Such small size makes it possible for the present invention to be used in combination with a handgun which is worn in a holster, without causing a snag or an impeded motion during withdrawing of the handgun.

As a further improvement in versatility, the distal end of the tubular assembly of the present invention is equipped with a spring-loaded plunger mechanism. When the tubular assembly is inserted into the bore and while the distal end portion thereof is engaged with the chamber plug member placed within the chamber, the tip of the plunger is forced against the bottom of the cavity within the chamber plug member and cause the spring to be compressed. The spring remains compressed until the device is unlocked, at which time the stored energy is unleashed to cause the plunger mechanism to push apart from the chamber plug member, and thus, forcing the tubular assembly to auto-eject out from the barrel of the firearm.

As briefly described above, the gun-lock device of the present invention provides many improvements and benefits over the prior art. With chamber plug member placed in the firing chamber, the tubular assembly is inserted through the gun barrel and only with a slight push inward of the chamber plug member made into the locked configuration without any additional input required by the gun-owner. To unlock, the ring finger of the gun-owner on which the key is worn is brought toward the head of the lock subassembly and guided only by the gun-owner's tactile senses the key may be correctly inserted into the tumbler cylinder. A simple twisting of the key unlocks the device and the tubular assembly immediately auto-ejects out from the gun barrel. The firearm is then ready to fire, in case of a revolver type gun, or immediately subsequent to cycling of the action, in case of a semi-automatic type gun. The ease and speed at which the present invention operates during both the lock and unlock operations coupled with its compact physical size provides a realistic option for the gun-owner to maintain his handgun locked at all times, including those times when the gun is carried in a holster worn by the gun-owner. The following illustrative drawings and detailed description make the foregoing and other objects, features, and advantages of the invention more apparent.

DETAILED DESCRIPTION OF THE INVENTION

FIGS. 1–16 of the drawings illustrate various aspects of a gun-lock device 10 constructed according to the invention. Although the following discussions may reference specific features and functions of a large-bore semi-automatic handgun, the inventive concepts disclosed and claimed are not restricted to such. A gun-lock device constructed according to the invention may be configured for use with any handgun or a long gun of semi-automatic, revolver, or of other action type of any caliber size, so as long as the firearm has a barrel with a bore and a chamber.

Figure 1:
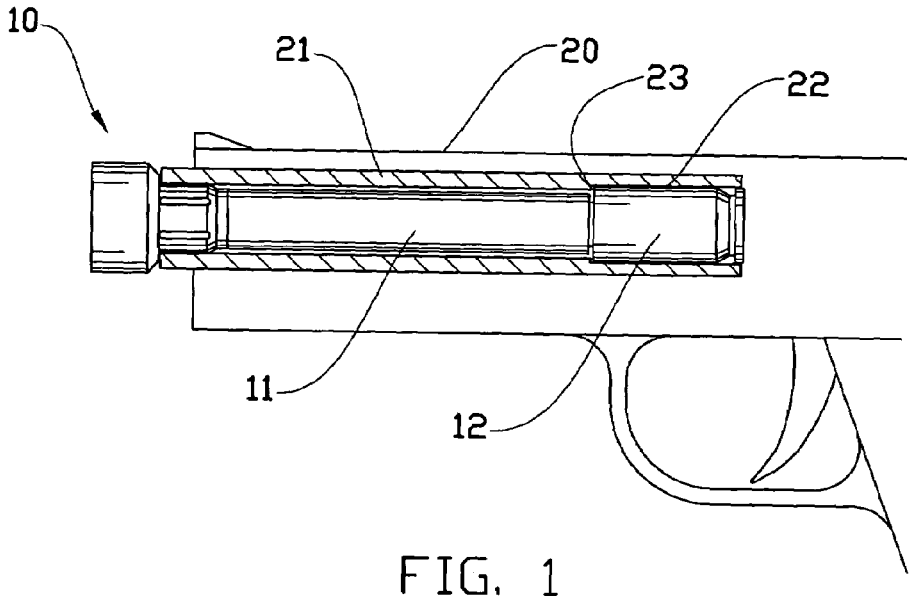
FIG. 1 of the drawings is a partial cross section showing the gun-lock device constructed according to the invention installed and lock in position with respect to a semi-automatic type handgun of a large bore size.
Figure 2:
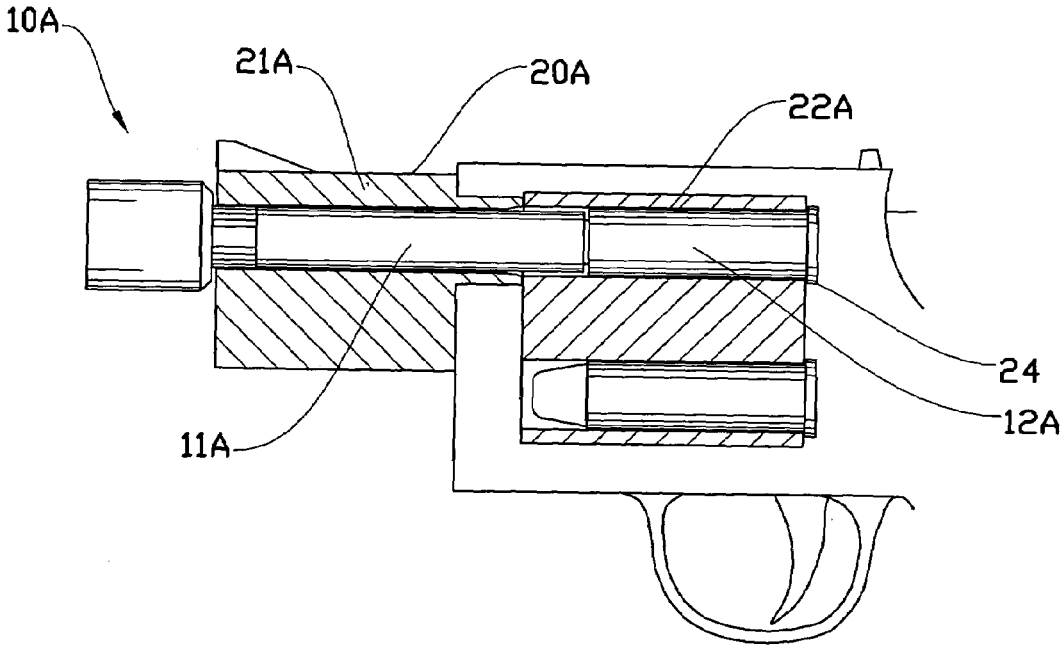
FIG. 2 is a partial cross section showing the gun-lock device installed and locked in position with respect to a revolver type handgun of a smaller bore size.

The gun-lock device 10 of FIG. 1 includes a tubular assembly 11 which is inserted from the muzzle end of the barrel 21 of the firearm 20 and a chamber plug member 12 which is inserted into the chamber 22 from the breach end of a semi-automatic handgun of such caliber as .40 S&W. The gun-lock device 10A of FIG. 2 is a variation adapted to work with a revolver of such caliber as .357 Magnum, wherein a tubular assembly 11A is inserted into the barrel and a chamber plug member 12A is inserted into the cylinder.

Figure 3:
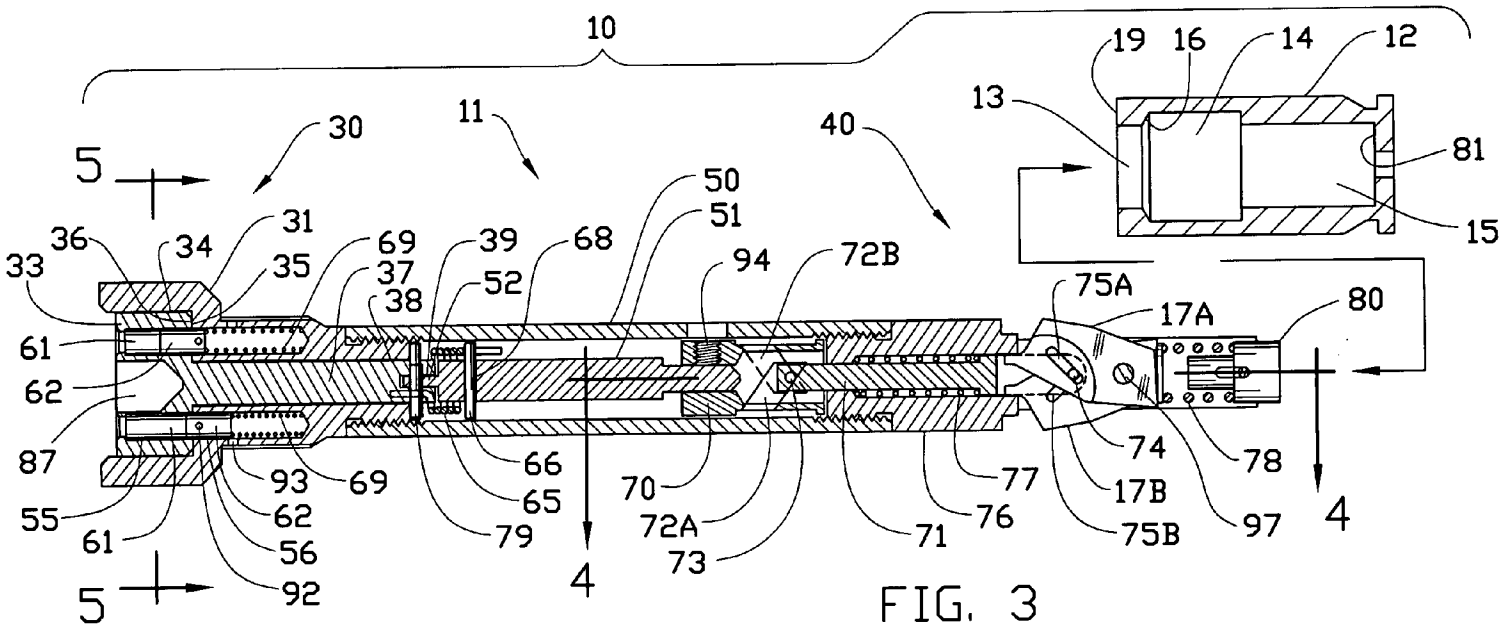
FIG. 3 is a foreshortened cross sectional view of the gun-lock device comprising a tubular assembly and a chamber plug member. For simplicity and clarity, the pairs of lock pins 61 and 62 and the associated features are shown aligned on the section plane shown.
Figure 4:
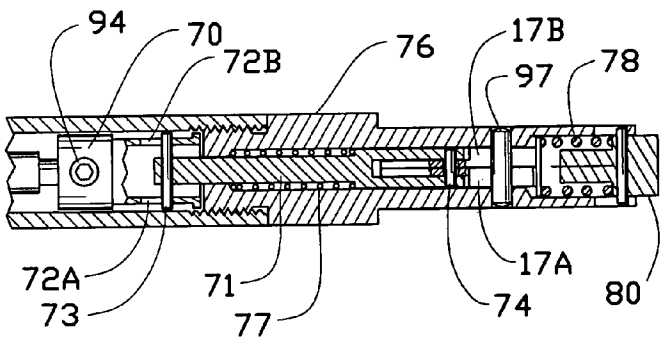
FIG. 4 is a partial cross section of the tubular assembly of the gun-lock device viewed along the section plane 4—4 and in the direction established in FIG. 3.

The chamber plug member also referred herein as "dummy cartridge" shares similar outside dimensions as the actual ammunition cartridge shell of corresponding caliber. In place of the bullet, explosive charge, and primer of the actual ammunition cartridge, however, the chamber plug member has an open forward end 13 and cavity 15, into which the distal end of the tubular assembly 11 is inserted, and a recess 14, into which barb members 17 (A and B) at the distal end of the tubular assembly expand into, and a shoulder 16, onto which the barb members abut to complete a locked engagement. These features of the chamber plug member are best illustrated in FIG. 3. In case of a semi-automatic type handgun, the proximal end 19 of the chamber plug member abuts the shoulder 23 formed at the depth of the chamber, thus eliminating the possibility of the chamber plug member from being pulled out from the chamber through the bore. In case of a revolver type handgun as shown in FIG. 2, rimmed flange 24 at the distal end of the chamber plug member fashioned after the corresponding actual cartridge eliminates the same concern.

The tubular assembly 11 further comprises the lock subassembly 30 and the actuator subassembly 40 which are mechanically joined at the ends of the tube member 50. The tube member is a hollow cylindrical tubing which may be fabricated at any specific length as required to produce the overall length of the tubular assembly needed to adapt to any model and manufacturer's handgun. The shaft 51 is also fabricated at any required length in combination with the tube member. This allows the same lock subassembly and the actuator subassembly to be used in various handgun applications of different barrel dimensions, thus helping to reduce the overall manufacturing cost. On the outer diameter of the lock subassembly is an indelible mark 32, which provides the user with a visual means for properly aligning the tubular assembly in relative angular orientation about the longitudinal axis of the gun barrel during installation. The reason for and the advantage of maintaining such installation orientation is to facilitate speedy engagement of the key with the lock subassembly during an unlock operation, which will become more apparent later as the process involving unlocking of the prevent invention is discussed in detail.

Figure 5A:
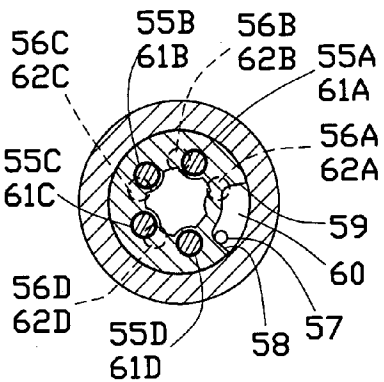
FIG. 5A is same as FIG. 5, except that it illustrates the lock subassembly at its unlocked position.
Figure 5:
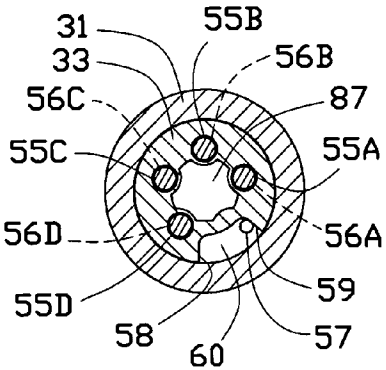
FIG. 5 is a partial cross section of the lock subassembly illustrating the relative positions of the elements of the subassembly at its locked position, viewed in the direction and along the section plane 5—5 established in FIG. 3.
Figure 6:
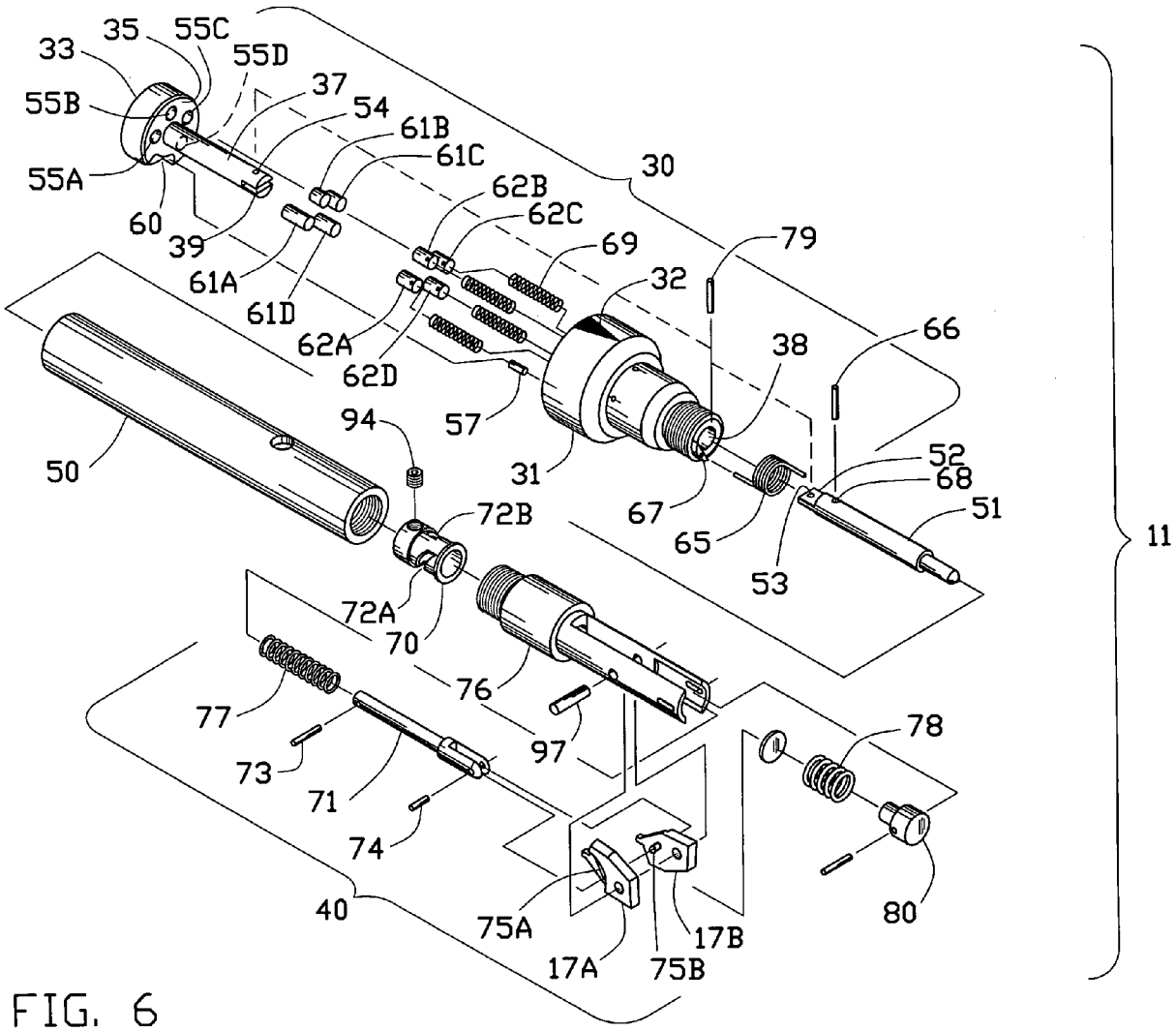
FIG. 6 is an isometric exploded view of the tubular assembly of the gun-lock device constructed according to the invention.

The lock subassembly incorporates a tumbler cylinder 33, wherein the major diameter portion fits snuggly inside cavity 34 of the lock body 31, the flat distal surface 35 abuts the flat bottom face 36 at the depth of the cavity 34, and a shank portion 37 which fits loosely within the bore 38 of the lock body. At the free end of the shank is a slit 39 into which the tab end portion 52 of the shaft 51 is inserted, and through the hole 54 in the shank portion 37 and the hole 53 in the tab end portion a pin 79 is inserted. This pin retains the shaft to the shank portion of the tumbler cylinder and also retains the tumbler cylinder to the lock body such that the rotational movement of the tumbler cylinder with respect to the lock body is permitted while the axial movement is not. The tumbler cylinder has a multiple set of holes 55 of first diameter starting from the flat distal surface 35 and terminating near the proximal end of the tumbler cylinder where smaller second diameter connects coaxially each of the first diameter and the proximal end of the tumbler cylinder. The lock body has a matching number of holes 56 of the same diameter as the first diameters of the holes 55 in the tumbler cylinder. On the flat bottom face 36 of the lock body is a press-fit pin 57, which is designed to abut the edges 58 and 59 created in the machined recess 60 on the flat distal surface of the tumbler cylinder such that the limits of the rotational movement of the tumbler cylinder with respect to the lock body is precisely governed at two positions. At the first of the said limit positions, the holes 55 in the tumbler cylinder align with the holes 56 in the body as shown in FIG. 5.

Figure 15:
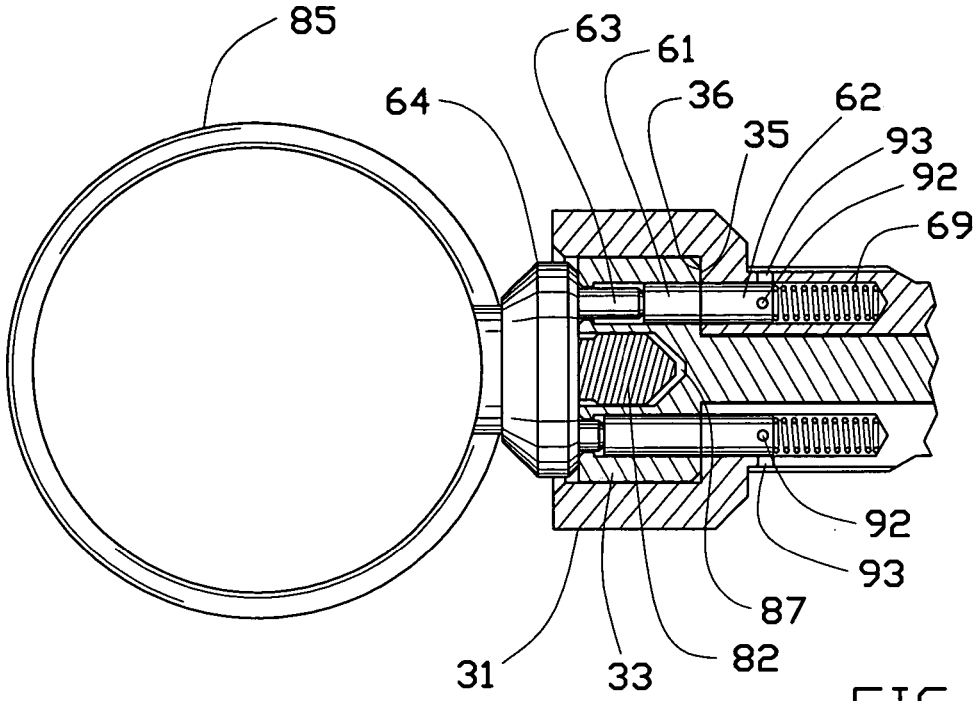
FIG. 15 is a partial cross section view of the lock subassembly with the correct key inserted. For simplicity and clarity, the pairs of lock pins 61 and 62 and the associated features are shown aligned on the section plane shown.

There are multiple pairs of lock pins encased one pair within each of the tubular cavity formed between the holes 55 in the tumbler cylinder and the holes 56 in the lock body when these holes are aligned at the first limit position of the tumbler cylinder as described above. The lock pins are loaded by the springs 69 such that the proximal face of the second pin 62 abuts the distal face of the first pin 61 and both are pushed toward the bottom end of the holes 55 in the tumbler cylinder. The first pins are of different lengths while the second pins are of the same length, and the lengths of the pins are determined such that when the tumbler cylinder is at said first limit position and without the correct key inserted the second pins are partially received into the holes 55 in the tumbler cylinder while the remaining portions of the second pins remain within the holes 56 in the lock body. This constitutes the "locked" configuration of the lock subassembly since the second pins 62 would prevent the tumbler cylinder from being rotated with respect to the lock body. The individual length of the first pins are predetermined such that when the correct key is inserted into the cylinder, each of the fingers 63 of the key element 64 displaces the corresponding pair of lock pins by a precise amount necessary for the abutting ends of the pairs of the pins 61 and 62 to align on the same plane where the flat distal surface 35 of the tumbler cylinder and the flat bottom face 36 of the lock body abut. This constitutes the "unlocked" configuration of the lock subassembly as all of the pins are now confined entirely within either the holes 55 in the tumbler cylinder or the holes 56 in the lock body, such that none of the pins obstruct the tumbler cylinder from being rotated with respect to the lock body. Such unlocked configuration of the lock subassembly is illustrated in FIG. 15. In the preferred embodiment there are four pairs of these pins arranged a circular formation on a pattern of equally spaced five holes. The fifth hole position is allotted for physically accommodating the press-fit pin 57 and the machined recess 60, both of which earlier described.

The lock subassembly also incorporates a torsional spring 65 which is connected at one end to the lock body at hole 67 (shown in FIG. 6) and the other end supported by the pin 66, which is loosed fit within the hole 68 of the shaft 51. The spring is preloaded to create a torque to bias the tumbler cylinder toward the locked position at all times, such that without the user intervention and with the key removed from the tumbler cylinder the lock subassembly is always returned to the locked configuration.

Figure 8:
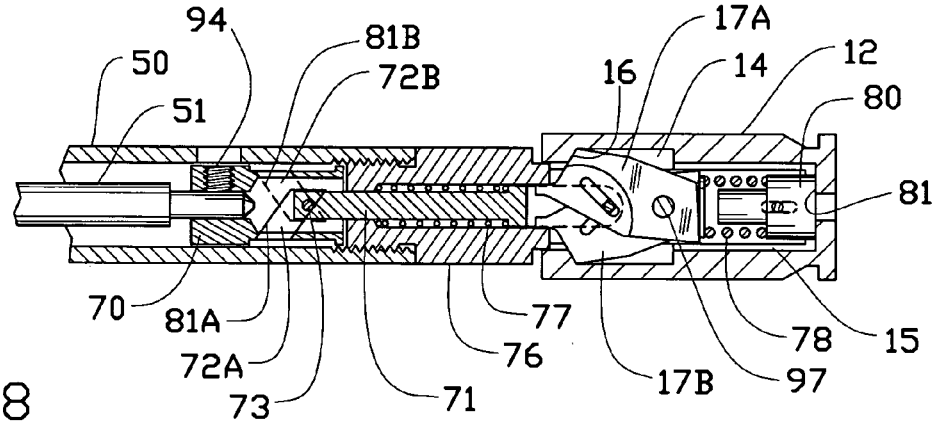
FIG. 8 is a partial cross section showing the tubular assembly installed and locked in position in cooperation with the chamber plug member. The bore and the chamber of the firearm's barrel are omitted for clarity.
Figure 9:
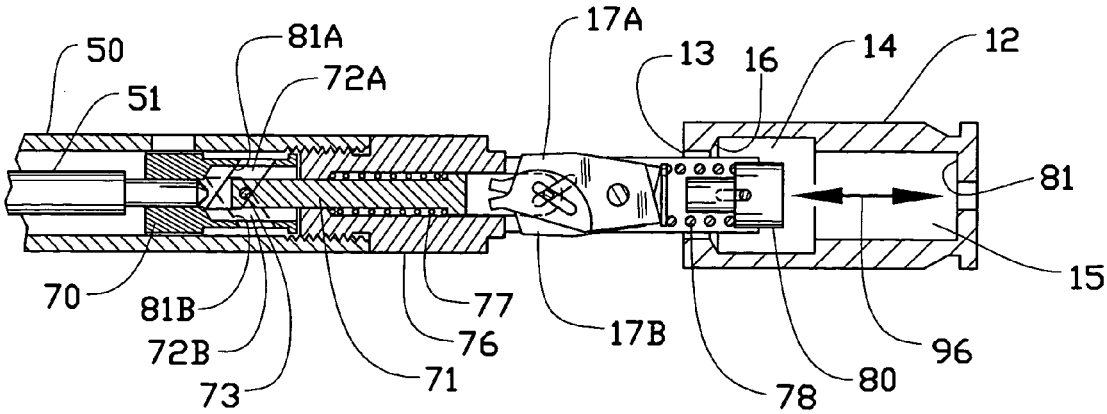
FIG. 9 is a partial cross section showing the tubular assembly actuated into the unlocked configuration and being ejected out from the chamber plug member. The bore and the chamber of the firearm's barrel are omitted for clarity.

The actuator subassembly 40 includes an adapter means 70 which is affixed to the distal end of the shaft 51 and connects with the rod member 71. The adapter means has a thin outer wall section wherein a pair of slots 72 (A and B) are machined there-through 180 degrees apart to form a pair of inclined surfaces which cooperate with the two ends of pin 73 which is loosely fit within the hole near the proximal end of the rod member. The pin is retained in place and prevented from being dislodged by the tube member 50. The rod member is arranged so that it is prevented from being rotated about the longitudinal axis of self and the angle of the slots 72 with respect to the transverse plane is such that a rotational movement transmitted by the shaft 51 causes a corresponding axial movement of the rod member 71. At the distal end of the rod member is a second pin 74, which is loosely fit in the holes through the rod member and within the slots 75 (A and B) of the pair of barb members 17 (A and B). The pin is retained in place and prevented from being dislodged by the actuator body 76. The barb members are pinned near the distal end of the actuator body 76 and are allowed to rotate about the pivot pin 97 between the retracted position, where it is shown in FIG. 9, and the expanded position, where it is shown in FIG. 8, depending on the axial placement of the rod member. The angle of the slots in the barb members is predetermined such that the resulting axial pull of the rod member when the tumbler cylinder is rotated from the locked position to the unlocked position causes the barb members to fully retract into the actuator body. The actuator subassembly also includes a compression spring 77 which creates force to bias the rod member toward the distal direction so as to eliminate any play between the pin 73 and the riding edges of the slots 72 (A and B) in the adapter means, and a second compression spring 78 which maintains force to bias the barb members toward the expanded positions at all times.

Figure 7:
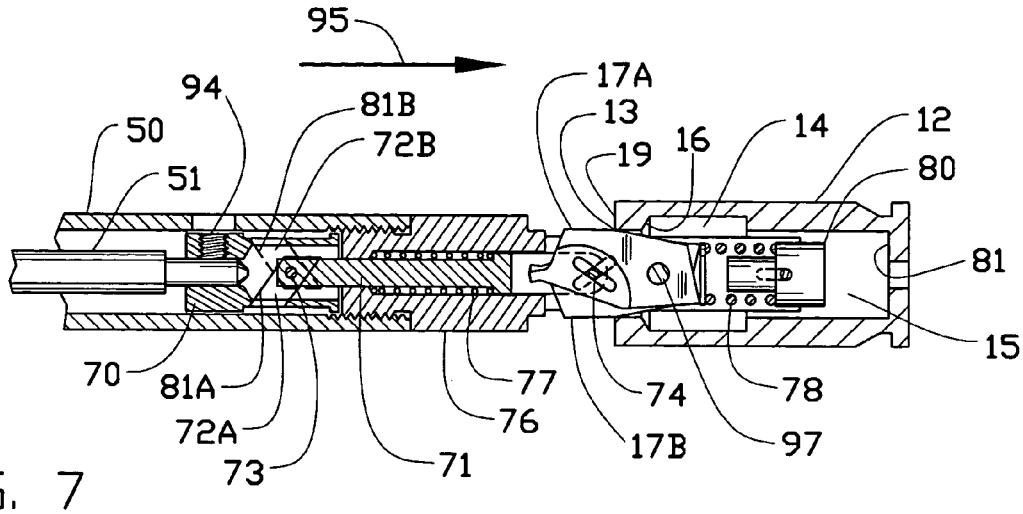
FIG. 7 is a partial cross section showing the tubular assembly being inserted into the chamber plug member. The bore and the chamber of the firearm's barrel are omitted from the view for clarity.

It is significant to note that the width of the pair of slots 72 (A and B) of the adapter means 70 is sufficiently greater than the diameter of the pin 73 as described above cooperates therewith. This allows, during the insertion of the tubular assembly into the gun barrel to engage with the chamber plug member, the barb members 17 (A and B) to be forced retracted on contact with the mouth of the open forward end 13 and therefore allow themselves to squeeze through the opening of the chamber plug member as shown in FIG. 7. The wider slot width does not obstruct the retraction of the barb members as it allows sufficient physical space for the pin 73 of the rod member to retract into, thereby preventing a possibility of a mechanical bind. Once squeezed through the open forward end of the chamber plug member the barb members return to their normally expanded positions into the recess 14 within the chamber plug member as shown in FIG. 8. These make it possible for the preferred embodiment to complete a lock operation only by exerting a simple relative inserting motion 95 of the tubular assembly inward of the chamber plug member without requiring any additional input from the user.

The actuator subassembly also includes a spring loaded plunger member 80. This plunger is energized by the spring 78 which is the same one that biases the barb members to expand as earlier described. The overall length to the free end of this spring loaded plunger member when the tubular assembly is at its natural state is greater than is allowed by the corresponding depth to the bottom 81 of the cavity 15 within the chamber plug member, such that when the gun-lock device is installed and locked the plunger is maintained compressed as shown in FIG. 8. When the device is unlocked, the energy of the spring is unleashed and causes the plunger to push apart from the bottom 81 of the chamber plug member, so the reaction force 96 propels the tubular assembly out from the chamber plug member and out of the gun barrel as shown in FIG. 9. This thus serves as auto-eject feature of the invention.

Figure 10:
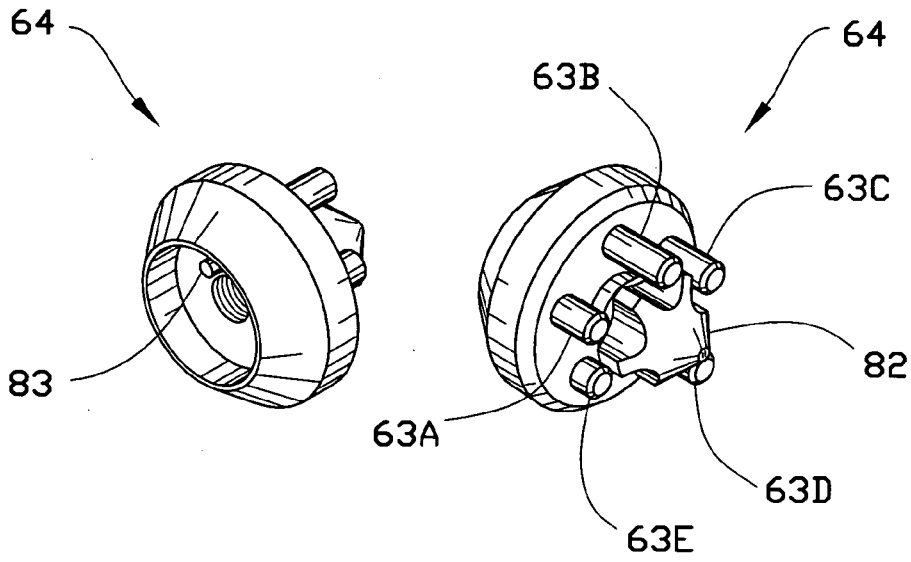
FIG. 10 shows enlarged isometric views of the key element shown from two different viewing angles.

FIG. 10 shows the key element 64 from two viewing angles. It has five fingers 63 (A thru E), which as earlier described are individually predetermined in length to correctly displace the four pairs of lock pins 61 and 62 of the lock subassembly. There are a total of five fingers in the preferred embodiment, of which four, 63A, 63B, 63C, and 63D, actually function in combination with the pairs of lock pins, whereas the fifth, 63E, is a dummy member intended for maintaining the aesthetic balance of the key design. As it may be apparent from the drawings of FIG. 10 and FIG. 11, the basis for the design of the key element, aside from the obvious functional objectives, is to render it ornate beauty such that the key element may be mounted on a substrate body 85 of ring shape and the assembly worn by the user as a ring. The circular formation of the five fingers surrounding the center projection feature 82 and the center projection feature incorporating tapered ends and relief cuts adjacent the five fingers is intended to enhance beauty by casting the key element design an illusion of a multi-facetted gem stone.

Figure 11:
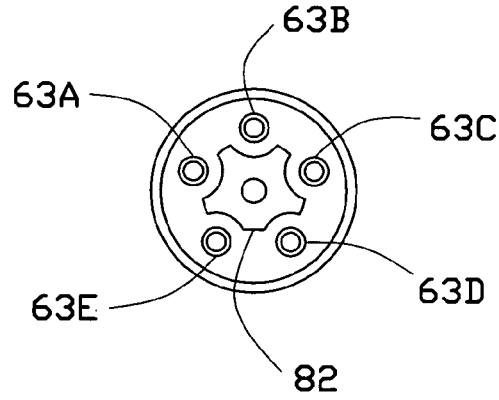
FIG. 11 shows the key element viewed directly from the front.
Figure 12:
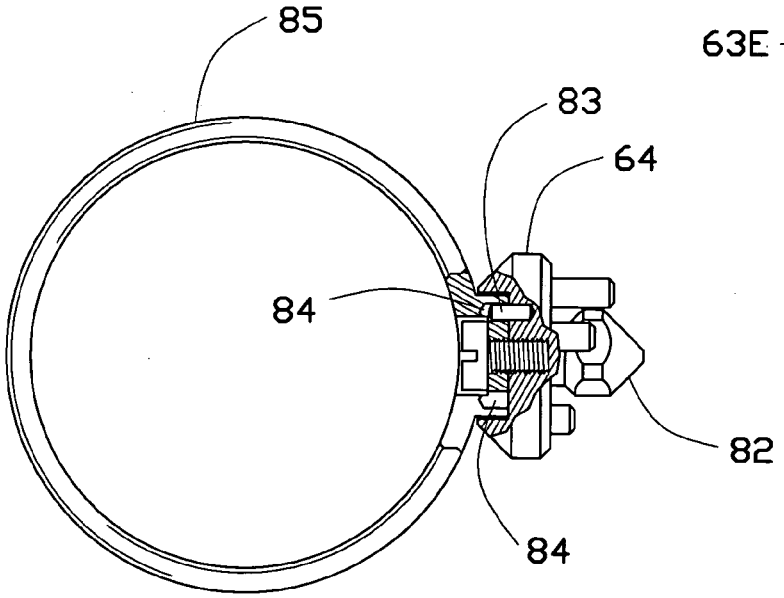
FIG. 12 is a partial cross section showing the key element mounted on a substrate body made to function as ring, to be worn on a finger of the authorized user.

On the rear of the key element is a locating pin 83 which is press-fit into the body of the key element and is designed to be received into any one of the four holes 84 which are equally spaced in a circular formation within the ring substrate 85. These features allow the user to selectively mount the key element in any one of four possible angular orientations with respect to the ring substrate. The orientation is selected based on the user's individual preference of how he wears the ring and how he naturally bring his ring finger toward the muzzle end of the firearm. To explain this more closely, with the tubular assembly already installed in a predetermined angular orientation about the longitudinal axis of the gun barrel, as aided by the indelible mark 32 on the periphery of the lock body 31 as earlier described, the key element should be mounted in such orientation with respect to the ring substrate that when the ring finger of the user is instinctively brought toward the gun which is held in his other hand in a manner most natural to the user, the key and the tubular assembly should already be aligned in a proper angular orientation with respect to each other. Once the key is brought into close proximity of the receiving end of the tumbler cylinder 33, the key may be guided into correct engagement as the tapered end of the center projection feature 82 guides itself into the mating recess 87 within the tumbler cylinder. Both the center projection feature 82 and the recess 87 have a matching asymmetrical geometry such that the key is prevented from being inserted into the lock subassembly without first being correctly oriented. The asymmetrical geometry of the center projection feature 82 is best shown in FIG. 11. All of these and many other features of the preferred embodiment are aimed at providing the user with a reliable means and method to ensure inserting the key into the lock subassembly and to unlock as quickly and instinctively as possible by use only of the user's tactile senses.

Figure 13:
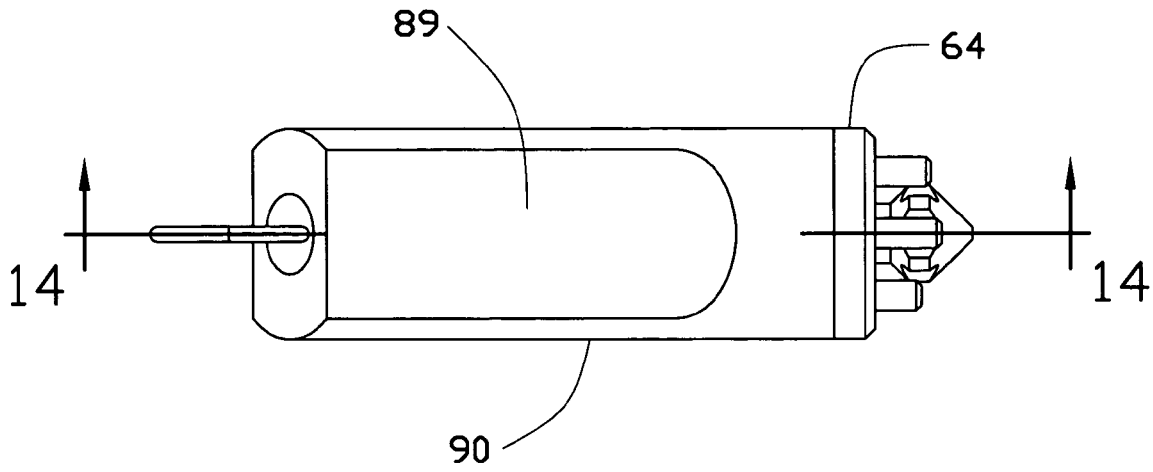
FIG. 13 shows the key element mounted on a substrate body made to function as a key chain.
Figure 14:
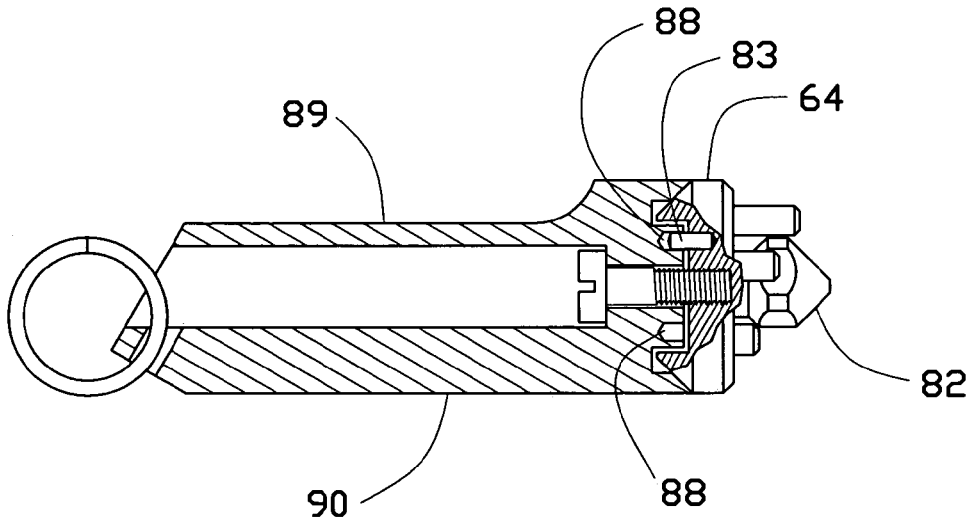
FIG. 14 is a partial cross section showing the key element mounted on a key chain substrate body viewed in the direction and along the section plane 14—14 established in FIG. 13.

The key element may also be installed on a substrate body of another shape to allow the assembly to be used as a key chain, as shown in FIG. 13 and FIG. 14. Similar to as with the ring substrate, the key chain substrate 90 has four equally spaced holes 88 to allow the key element to be mounted in any one of the four possible orientations. The peripheral geometry of the key chain substrate is mostly symmetrical, except for the flat feature 89 which is incorporated into the body to provide the user a tactile means for determining the orientation of the key assembly so as to facilitate speedy engagement of the key into the lock subassembly as described above.

In addition to the unique and advanced functional design features outlined above, the preferred embodiment is designed and manufactured with many provisions aimed at making the present invention tamper-resistant. First, the only exposed features of the gun-lock device external to the gun barrel, the lock body 31 and the exposed face of the cylinder 33, are manufactured of hardened steel or a case-hardened steel, to make these extremely difficult to be cut or drilled using an ordinary metal hacksaw, drill, or any tool common to a thief. Further, the same exposed features consist of a substantially smooth and continuous surfaces without a kind of discontinuity nor textures which may serve as pry points or traction-enhancers, thus rendering these difficult to be pried apart or be grabbed and pulled, using a screw-driver, a pair of pliers or any other ordinary tool common to a thief, to inflict any serious damage to the gun-lock device.

Figure 16:
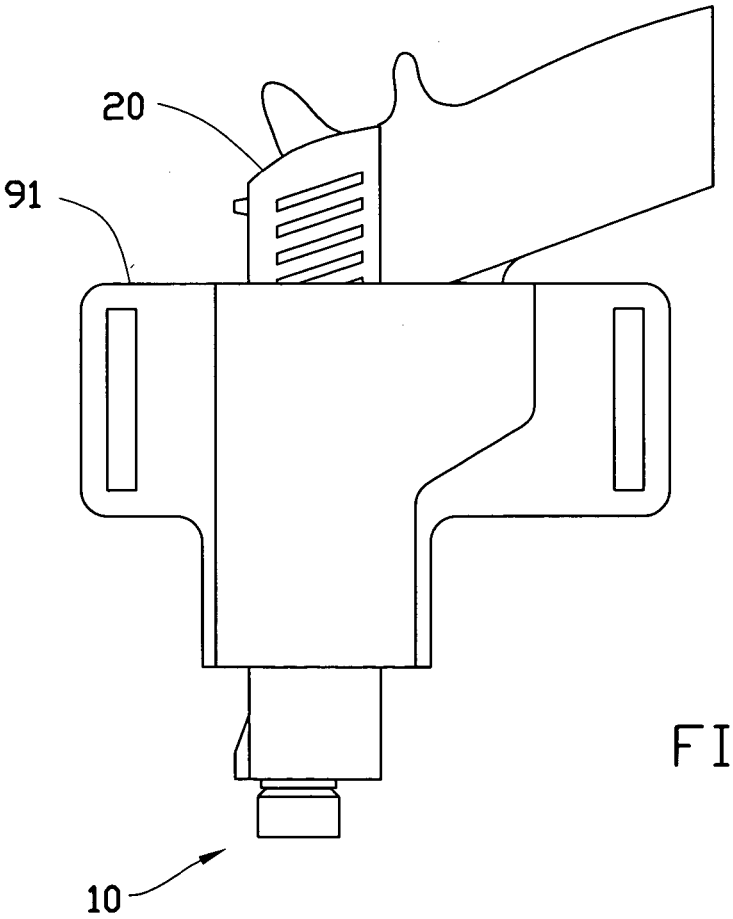
FIG. 16 shows the gun-lock device installed and locked in position in combination with a handgun in a holster.

The compact size of the exposed portion of the gun-lock device which remain external to the gun barrel in connection with their smooth and continuous external characteristics as described make the preferred embodiment of the present invention also ideal for being used on a holstered handgun without causing a snag or an impeded motion while the gun is being withdrawn from the holster. FIG. 16 illustrates such application of the gun-lock device 10 installed on a handgun 20 mounted in a holster 91.

Ease of assembly during fabrication is an added feature of the preferred embodiment. For benefits which include speedy assembly, lower cost, and minimum required physical space, many of the components within the preferred embodiment are joined together using clearance-fit pins which, when the overall assembly is completed, are maintained in their places and are prevented from being dislodged. There are holes 93 (shown in FIG. 15) on the periphery of the lock body extending radially inward to allow a small diameter wire to be inserted therein and into the holes 92 of the second pins 62 to hold the second pins against the force of the compression spring 69 during the tumbler cylinder assembly operation. The lock subassembly 30 and the actuator subassembly 40 may be fabricated and stored as common subassemblies and later combined with the tube member 50 and rod member 51 of correct length during the final assembly operation. After the final assembly, the adjustment is complete when the adapter means 70 is properly positioned to remove any play between the slot 72 and the pin 73 and the screw 94 is tightened to secure this setting.

The present invention thus provides a gun-lock device of the barrel lock type with a chamber plug member which provides the user with a speedy, reliable, and instinctive operation while also offering functional versatility and ease of assembly. Based upon the foregoing, one of ordinary skill in the art can readily practice the invention. Although an outstanding embodiment have been shown and described, it is believed that one of ordinary skill in the art may make change, modifications, and substitutions without necessarily departing from the spirit and scope of the invention.

I claim:

1. A gun-lock device for a firearm having a barrel with a generally cylindrical bore therein and a generally cylindrical chamber of diameter greater than that of the bore for receiving an ammunition cartridge in alignment with said bore, and said gun-lock device comprising:

a dummy cartridge chamber plug member with exterior dimensions similar to said ammunition cartridge for said firearm's chamber, wherein said chamber plug member having a hollow interior and having an open forward end of diameter less than that of said bore and that of the hollow interior;

a tube adapted to be inserted coaxially into the bore, the tube having a proximal end portion, a distal end portion, and a length sufficient to extend from the muzzle to the chamber, wherein the distal end portion of the tube extending into said hollow interior of the chamber plug member;

a distal subassembly on the distal end portion of the tube defining at least one barb member pivotally mounted and operated through a partial pivotal movement between a first position corresponding to the first configuration of the distal subassembly wherein the diameter to the tip of the barb member is greater than that of said open forward end of the chamber plug member so that the distal subassembly does obstruct removal of the tube from the chamber plug member, and a second position corresponding to the second configuration of the distal subassembly wherein the diameter to the tip of the barb member is less than that of said open forward end of the chamber plug member so that the distal subassembly does not obstruct removal of the tube from the chamber plug member and the bore;

a lock subassembly on the proximal end of the tube for enabling a user to selectively move the distal subassembly between said first and second configurations while the correct key is inserted, the lock subassembly including a tumbler cylinder adapted to be rotated about the longitudinal axis of the tube a partial turn between a first position of the tumbler cylinder corresponding to the distal subassembly being in said first configuration and a second position of the tumbler cylinder corresponding to the distal subassembly being in said second configuration, and the lock subassembly including means for locking the tumbler cylinder in the first position; and an actuator subassembly disposed within the tube for transmitting the rotational movement from the tumbler cylinder of the lock subassembly to a movement of a rod member and transferring it to the distal subassembly, wherein the actuator subassembly including (i) a shaft disposed coaxially within the tube wherein the proximal end of the shaft is connected to said tumbler cylinder of the lock subassembly to couple rotational movement thereof, (ii) an adapter means connected at the distal end of said shaft to couple movement thereof and, and (iii) said rod member disposed coaxially within the tube and so arranged to connect the motion between said adapter means and the distal subassembly.

2. A device in combination with a firearm as recited in claim 1, wherein:

said adapter means of the actuator subassembly defining an inclined surface feature therein for said rod member to cooperate and said rod member so arranged such that it is prevented from being rotated about the longitudinal axis of the tube, and that rotational movement of the adapter means causes the rod member to move axially along the longitudinal axis of the tube; and said barb member of the distal subassembly including an inclined surface feature therein for the distal end portion of said rod member to cooperate, such that the axial movement of said rod member causes a pivotal movement of the barb member.

3. A device in combination with a firearm as recited in claim 2, wherein:

said rotational movement of the tumbler cylinder of the lock subassembly from said first position to said second position causes an axial movement of the rod member toward the proximal end of the tube and the tumbler cylinder rotation from the second position to the first position causes an axial movement of the rod member away from the proximal end of the tube; and said axial movement of the rod member toward the proximal end of the tube causes a pivotal movement of the barb member toward said second position of the barb member and axial movement of the rod member away from the proximal end of the tube causes a pivotal movement of the barb member toward said first position of the barb member.

4. A device in combination with a firearm as recited in claim 2, wherein said inclined surface feature within said adapter means does not obstruct the axial movement of said rod member toward the proximal end of the tube irrespective of the position of the tumbler cylinder of the lock subassembly to the extent that said barb member may be allowed to be moved from said first configuration of the distal subassembly to the said second configuration upon contacting with said open forward end during a relative movement of the distal subassembly inward of the chamber plug member.

5. A device in combination with a firearm as recited in claim 1, wherein said distal subassembly including a compression spring so arranged that it creates force to bias said barb member toward said first configuration of the distal subassembly.

6. A device in combination with a firearm as recited in claim 1, including a spring-loaded plunger arrangement at the distal end portion of said tube and so adapted to fit within said hollow interior of the chamber plug member, wherein the length to the tip of the plunger arrangement at its natural state is greater than the corresponding depth dimension allowed by said hollow interior in the chamber plug member, such that while the distal portion of the tube is extended into the hollow interior of the chamber plug member and the distal subassembly maintained at said first configuration, the plunger arrangement is maintained compressed, and when the distal subassembly is moved into said second configuration the energy stored in the spring-loaded plunger arrangement is unleashed to push the tube apart from the bottom of said hollow interior of the chamber plug member.

7. A device in combination with a firearm as recited in claim 1, including a torsional spring disposed within the tube and so arranged such that it creates torque to bias said tumbler cylinder toward said first position.

8. A device in combination with a firearm as recited in claim 1, wherein said barb member at the distal portion of the tube consists of two barb members, symmetrically disposed about the longitudinal axis of the tube to operate in opposing directions from each other.

9. A device in combination with a firearm as recited in claim 1, wherein said key comprises a key element including all of the features required for proper operation according to the invention and so arranged to allow it to be mounted onto various substrate bodies for ease of handling, wherein various substrate bodies including a ring which may be worn on a finger of the user.

10. A device in combination with a firearm as recited in claim 1, wherein a means for locking said tumbler cylinder in the first position including:

a lock body connected to the proximal end of the tube having a first recess coaxial with the tube, wherein it is open toward the proximal end of the lock body and is closed toward the distal end with a flat bottom face which is perpendicular to the longitudinal axis of the tube, and a plurality of recesses disposed in a circular formation about the longitudinal axis of the first recess, wherein the plurality of recesses starting from said flat bottom face and extending toward the distal end of the lock body with their longitudinal axes parallel to that of the first recess;

said tumbler cylinder so adapted to be received into said first recess of the lock body and having a flat distal surface, so arranged to abut said flat bottom face in the lock body, and a plurality of recesses disposed in a circular formation about the longitudinal axis of the tumbler cylinder, wherein the plurality of recesses starting from said distal flat surface and extending toward the proximal end of the tumbler cylinder with their longitudinal axes parallel to that of the tube, and the tumbler cylinder so arranged that when it is at said first position, the plurality of recesses therein are in alignment with said plurality of recesses in the lock body;

a plurality of a pairs of cylindrical members consisting of first members and second members, wherein the first members are of varying lengths along the longitudinal axes thereof and each of the first members are axially disposed within each of said plurality of recesses in the tumbler cylinder and each of the second members are axially disposed within each of said plurality of recesses in the lock body; and a spring at the distal end of each of said second members within each of the plurality of recesses in the lock body.

11. A device in combination with a firearm as recited in claim 10, wherein:

said pairs of cylindrical members and said plurality of recesses in the tumbler cylinder are arranged in such physical proportions that while the tumbler cylinder is at said first position, each of the pairs of cylindrical members are preloaded by each of said springs toward the proximal end within each of the plurality of recesses in the tumbler cylinder and result in the proximal portions of each of said second members of the pairs of cylindrical members being received partially into each of the plurality of recesses in the tumbler cylinder while the remaining portions of the second members remain within the plurality of recesses in the lock body, thus, the second members obstruct the tumbler cylinder rotation; and said first members of said varying lengths of the pairs of cylindrical members are individually so assigned to each of said plurality of recesses in the tumbler cylinder, such that when a correct key is inserted into the tumbler cylinder, each of the pairs of the cylindrical members are displaced toward the distal end of the plurality of recesses in the lock body by a precise amount, such that the entire portion of each of said first members remain within each of the plurality of recess in the tumbler cylinder and the entire portion of each of said second members remain within each of the plurality of recesses in the lock body, thus, none of the first members nor second members obstruct the tumbler cylinder rotation.

12. A device in combination with a firearm as recited in claim 10, wherein said plurality of pairs of cylindrical members consist of four pairs, and said varying lengths of the first members are five lengths in equally divisible increments.

13. A device in combination with a firearm as recited in claim 11, wherein said tumbler cylinder further including a frontal face fully unobstructed toward the proximal end of the tube and a plurality of apertures of the same quantity as, and of diameter less than, that of said plurality of recesses within the tumbler cylinder, wherein each of the apertures are coaxially aligned with each of the plurality of recesses in the tumbler cylinder and connecting between said frontal face and the bottom depth of each of the plurality of recesses in the tumbler cylinder.

14. A device in combination with a firearm as recited in claim 13, wherein said key comprises a base surface and plurality of fingers projecting from the same, wherein the quantity of said fingers is at least that of said plurality of apertures and the individual length and placement of each of the fingers are so defined that when the key is correctly inserted and that said base surface of the key abuts said frontal face of the tumbler cylinder, each of said pairs of cylindrical members are displaced by the corresponding finger by the exact amount required to allow the tumbler cylinder rotation as said.

15. A gun-lock device for a firearm having a barrel with a generally cylindrical bore therein and a generally cylindrical chamber of diameter greater than that of the bore for receiving an ammunition cartridge in alignment with said bore, said gun-lock device comprising:

a dummy cartridge chamber plug member with exterior dimensions similar to said ammunition cartridge for said firearm's chamber, wherein said chamber plug member having a hollow interior and having an open forward end of diameter less than that of said bore and that of the hollow interior;

a tube adapted to be inserted coaxially into the bore, the tube having a proximal end portion, a distal end portion, and a length sufficient to extend from the muzzle to the chamber, wherein the distal end portion of the tube extending into said hollow interior of the chamber plug member;

a distal subassembly on the distal end portion of the tube that is adapted to be moved under user control between a first configuration of the distal subassembly that does not fit said open forward end of said chamber plug member so that the distal subassembly does obstruct removal of the tube from the chamber plug member, and a second configuration of the distal subassembly that does fit said open forward end so that the distal subassembly does not obstruct removal of the tube from the chamber plug member and the bore;

a lock subassembly on the proximal end of the tube for enabling a user to selectively move the distal subassembly between said first and second configurations while the correct key is inserted, the lock subassembly including a tumbler cylinder adapted to be rotated about the longitudinal axis of the tube a partial turn between a first position of the tumbler cylinder corresponding to the distal subassembly being in said first configuration and a second position of the tumbler cylinder corresponding to the distal subassembly being in said second configuration, and the lock subassembly including means for locking the tumbler cylinder in the first position;

an actuator subassembly disposed within the tube for transmitting the rotational movement from the tumbler cylinder of the lock subassembly to a movement of a rod member and transferring it to the distal subassembly, wherein the actuator subassembly including (i) a shaft disposed coaxially within the tube wherein the proximal end of the shaft is connected to said tumbler cylinder of the lock subassembly to couple rotational movement thereof, (ii) an adapter means connected at the distal end of said shaft to couple movement thereof, and (iii) said rod member disposed coaxially within the tube and so arranged to connect the motion between the adapter means and the distal subassembly; and a means for locking said tumbler cylinder in the first position including (i) a lock body connected to the proximal end of the tube and having a first recess coaxial with the tube, wherein the first recess is open toward the proximal end of the lock body and is closed toward the distal end of the lock body with a flat bottom face which is perpendicular to the longitudinal axis of the first recess, and a plurality of recesses disposed in a circular formation about the longitudinal axis of the first recess, wherein each of the plurality of recesses starting from said flat bottom face and extending toward the distal end of the lock body with their longitudinal axes parallel to that of said first recess; (ii) said tumbler cylinder coaxially received into said first recess of the lock body and having a flat distal surface, so arranged to abut said flat bottom face of the lock body, and a plurality of recesses disposed in a circular formation about the longitudinal axis of the tumbler cylinder, wherein each of the plurality of recesses starting from said distal flat surface and extending toward the proximal end of the tumbler cylinder with their longitudinal axes parallel to that of the tumbler cylinder, and the tumbler cylinder so arranged that while it is at said first position, said plurality of recesses therein are in alignment with said plurality of recesses in the lock body; (iii) a plurality of pairs of cylindrical members consisting of first members and second members, wherein the first members are of varying lengths along the longitudinal axes thereof and each of the first members axially disposed within each of said plurality of recesses in the tumbler cylinder and each of the second members axially disposed within each of said plurality of recesses in the lock body; and (iv) a spring at the distal end of each of the second members within each of said plurality of recesses in the lock body.

16. A device in combination with a firearm as recited in claim 15, wherein:

said pairs of cylindrical members and said plurality of recesses in the tumbler cylinder are arranged in such physical proportions that while the tumbler cylinder is at said first position, each of the pairs of cylindrical members are preloaded by each of said springs toward the proximal end within each of the plurality of recesses in the tumbler cylinder and result in the proximal portions of each of said second members of the pairs of cylindrical members being received partially into each of the plurality of recesses in the tumbler cylinder while the remaining portions of the second members remain within the plurality of recesses in the lock body, thus, the second members obstruct the tumbler cylinder rotation; and said first members of said varying lengths of the pairs of cylindrical members are individually so assigned to each of said plurality of recesses in the tumbler cylinder, such that when a correct key is inserted into the tumbler cylinder, each of the pairs of the cylindrical members are displaced toward the distal end of the plurality of recesses in the lock body by a precise amount, such that the entire portion of each of said first members remain within each of the plurality of recess in the tumbler cylinder and the entire portion of each of said second members remain within each of the plurality of recesses in the lock body, thus, none of the first members nor second members obstruct the tumbler cylinder rotation.

17. A device in combination with a firearm as recited in claim 15, wherein said plurality of pairs of cylindrical members consist of four pairs and said varying lengths of the first members are five lengths in equally divisible increments.

18. A device in combination with a firearm as recited in claim 15, wherein said adapter means of the actuator subassembly defining an inclined surface feature therein for said rod member to cooperate and said rod member so arranged such that it is prevented from being rotated about the longitudinal axis of the tube, and that rotational movement of the adapter means causes the rod member to move axially along the longitudinal axis of the tube.

19. A device in combination with a firearm as recited in claim 15, wherein said rotational movement of the tumbler cylinder of the lock subassembly from said first position to the second position causes an axial movement of the rod member toward the proximal end of the tube and the tumbler cylinder rotation from the second position to the first position causes an axial movement of the rod member away from the proximal end of the tube.

20. A device in combination with a firearm as recited in claim 18, wherein said inclined surface feature within said adapter means does not obstruct the axial movement of said rod member toward the proximal end of the tube irrespective of the position of the tumbler cylinder of the lock subassembly to the extent that said distal subassembly be allowed to be moved from said first configuration of the distal subassembly to said second configuration upon contacting with said open forward end during a relative movement of the distal subassembly inward of the chamber plug member.

21. A device in combination with a firearm as recited in claim 15, including a spring-loaded plunger arrangement at the distal end portion of said tube and so adapted to fit within said hollow interior of the chamber plug member, wherein the length to the tip of the plunger arrangement at its natural state is greater than the corresponding depth dimension allowed by said hollow interior of the chamber plug member, such that while the distal portion of the tube is extended into the hollow interior of the chamber plug member and the distal subassembly maintained at said first configuration, the plunger arrangement is maintained compressed, and when the distal subassembly is moved into said second configuration the energy stored in the spring-loaded plunger arrangement is unleashed to push the plunger apart from the bottom of said hollow interior of the chamber plug member.

22. A device in combination with a firearm as recited in claim 15, including a torsional spring disposed within the tube and so arranged such that it creates torque to bias said tumbler cylinder toward said first position.

23. A device in combination with a firearm as recited in claim 15, wherein said distal subassembly including a spring so arranged that it creates force to bias the distal subassembly into said first configuration.

24. A device in combination with a firearm as recited in claim 16, wherein said tumbler cylinder further including a frontal face fully unobstructed toward the proximal end of the tube and a plurality of apertures of the same quantity as and of diameter less than that of said plurality of recesses in the tumbler cylinder, wherein each of the apertures are coaxially aligned with each of the plurality of recesses in the tumbler cylinder and connecting between said frontal face and the bottom depth of each of the plurality of recesses in the tumbler cylinder.

25. A device in combination with a firearm as recited in claim 24, wherein said key comprises a base surface and plurality of fingers projecting from the same, wherein the quantity of said fingers is at least that of said plurality of apertures and the individual length and placement of each of the fingers are so defined that when the key is correctly inserted and that said base surface of the key abuts said frontal face of the tumbler cylinder, each of said pairs of cylindrical members are displaced by the corresponding finger by the exact amount required to allow the tumbler cylinder rotation as said.

26. A device in combination with a firearm as recited in claim 15, wherein said key comprises a key element including all of the features required for proper operation according to the invention and so arranged to allow it to be mounted onto various substrate bodies for ease of handling, wherein various substrate bodies including a ring which may be worn on a finger of the user.

* * * * *